US007239832B2

(12) United States Patent
Takashima et al.

(10) Patent No.: US 7,239,832 B2
(45) Date of Patent: Jul. 3, 2007

(54) DEVELOPER REGULATION MEMBER AND DEVELOPING APPARATUS

(75) Inventors: Koichiro Takashima, Numazu (JP); Yasuyuki Ishii, Mishima (JP); Masato Koyanagi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 76 days.

(21) Appl. No.: 10/890,147

(22) Filed: Jul. 14, 2004

(65) Prior Publication Data

US 2005/0025531 A1 Feb. 3, 2005

(30) Foreign Application Priority Data

Jul. 17, 2003 (JP) ..... 2003-276048

(51) Int. Cl.
*G03G 15/08* (2006.01)

(52) U.S. Cl. ..... 399/284

(58) Field of Classification Search ..... 399/274, 399/284

See application file for complete search history.

(56) References Cited

U.S. PATENT DOCUMENTS

| | | | | |
|---|---|---|---|---|
| 4,498,756 | A * | 2/1985 | Hosoya et al. | 399/284 |
| 4,662,311 | A * | 5/1987 | Shoji et al. | 399/274 X |
| 5,729,806 | A * | 3/1998 | Niwano et al. | 399/284 |
| 5,863,329 | A * | 1/1999 | Yamanouchi | 399/274 X |
| 5,870,658 | A * | 2/1999 | Goto et al. | 399/284 |
| 5,893,013 | A | 4/1999 | Kinoshita et al. | 399/284 |
| 6,256,471 | B1 | 7/2001 | Sato et al. | 399/284 |
| 6,308,038 | B1 | 10/2001 | Kakeshita et al. | 399/286 |
| 6,360,068 | B1 | 3/2002 | Kinoshita et al. | 399/284 |
| 6,463,246 | B1 * | 10/2002 | Mizuno et al. | 399/284 |
| 6,542,710 | B2 | 4/2003 | Kakeshita et al. | 399/281 |
| 6,873,816 | B2 | 3/2005 | Akashi et al. | 399/286 |
| 2002/0159798 | A1 * | 10/2002 | Yamamoto et al. | 399/284 |
| 2003/0223783 | A1 | 12/2003 | Yamamoto et al. | 399/284 |

FOREIGN PATENT DOCUMENTS

| | | |
|---|---|---|
| CN | 1267003 | 9/2000 |
| CN | 1403883 | 3/2003 |
| EP | 0 665 474 A2 | 1/1995 |
| EP | 1 113 339 A2 | 7/2001 |

(Continued)

OTHER PUBLICATIONS

Patent Abstracts of Japan, Publication No. 60-51857, Mar. 23, 1985.

(Continued)

*Primary Examiner*—Sandra L. Brase
(74) *Attorney, Agent, or Firm*—Fitzpatrick, Cella, Harper & Scinto

(57) ABSTRACT

A developer regulation member includes developer regulation device for regulating an amount of developer carried on a developer carrying member. The developer regulation device includes a first regulation portion formed of a first material which has a Shore D hardness of not less than 70 degrees or is metal, and a second regulation portion which is disposed opposite to the developer carrying member and is formed of a material different from the first material for the first regulation portion. The second regulation portion has an edge which is in contact with the developer carrying member.

46 Claims, 8 Drawing Sheets

FOREIGN PATENT DOCUMENTS

| | | |
|---|---|---|
| JP | 60-51857 | 3/1985 |
| JP | 6-258926 | 9/1994 |
| JP | 11-149175 | 6/1999 |
| JP | 2000-112230 | 4/2000 |
| JP | 2001-147585 | 5/2001 |
| JP | 2002-207355 | 7/2002 |

OTHER PUBLICATIONS

Patent Abstracts of Japan, Publication No. 2000-112230, Apr. 21, 2000.
Patent Abstracts of Japan, Publication No. 2001-147585, May 29, 2001.
Patent Abstracts of Japan, Publication No. 2002-207355, Jul. 26, 2002.

* cited by examiner

DEVELOPER REGULATION MEMBER AND DEVELOPING APPARATUS

FIELD OF THE INVENTION AND RELATED ART

The present invention relates to a developer regulation member for regulating an amount of developer carried on a developer carrying member and a developing apparatus including the developer regulation member. The developer regulation member and the developing apparatus may preferably be used in an electrophotographic image forming apparatus, having a function of forming an image on a transfer material (recording medium), such as a copying machine, a printer or a facsimile machine.

In recent years, with progress of office automation, electrophoretic image forming apparatuses, such as a laser (beam) printer, as an output terminal of a computer, a facsimile machine or a copying machine, have been frequently used. These image forming apparatuses generally include a charger for electrically uniformly charging a photosensitive drum as an image bearing member; an exposure apparatus for forming an electrostatic latent image on the photosensitive drum through light irradiation; a developing apparatus for developing the electrostatic latent image on the photosensitive drum with developer (toner) to provide a visible (toner) image; an image transfer apparatus for transferring the toner image formed on the photosensitive drum by development onto a recording medium, such as recording paper; and an image fixing apparatus for melting the toner image transferred onto the recording medium and fixing it thereon.

The developing apparatus ordinarily comprises a developing roller, as a developer carrying member, disposed close to or in contact with the photosensitive drum; a toner container for containing toner, a toner supply apparatus for supplying the toner onto the developing roller; and a developing blade, as a developer regulation member, for regulating a thickness of a layer of the toner (an amount of toner) supplied onto the developing roller. From the toner layer on the developing roller, toner is uniformly deposited electrically on the electrostatic latent image formed on the photosensitive drum, thus effecting development, i.e., visualization of the electrostatic latent image. Further, in order to use the photosensitive drum, from which the toner image has been transferred onto the recording medium, in a subsequent image forming process (cycle), around the photosensitive drum, a charge-removing apparatus for removing an electric charge from the surface of the photosensitive drum and a cleaning apparatus for scraping residual toner from the photosensitive drum surface are also disposed.

Further, in order to use the photosensitive drum, from which the toner image has been transferred onto the recording medium, in a subsequent image forming process (cycle), around the photosensitive drum, a charge-removing apparatus for removing an electric charge from the surface of the photosensitive drum and a cleaning apparatus for scraping residual toner from the photosensitive drum surface are also disposed.

The above-described developing apparatus used in the image forming apparatus conventionally includes an apparatus designed to use a monocomponent type developer constituting only toner and an apparatus designed to use a two component type developer comprising a combination of a carrier with toner. The monocomponent type developing apparatus does not use the toner, so that it is not particularly necessary to pay attention to a deterioration of the carrier, mixing and a mixing ratio of the carrier with the toner. As a result, it is possible to reduce a size and a production cost of the apparatus. Further, the monocomponent type developing apparatus also has an advantage that a high-quality color image can be formed since toner has a high transparency when the developer used is nonmagnetic.

In the case where the monocomponent type developing apparatus, the monocomponent type developer does not contain the carrier, so that it is necessary to perform a step of forcedly charging the developer and deposit the developer on the developing roller by imparting an electric charge to the developing roller, different from the case of the two component type developing apparatus wherein developer comprising a mixture of the carrier and toner is used and deposited on a magnet roller. For this reason, the monocomponent type developing apparatus is also provided with a triboelectrically charging member for imparting a triboelectric charge to the toner.

As the triboelectrically charging member, e.g., a developing blade for regulating a layer of toner deposited on the developing roller in a uniform predetermined thickness or a charging member or the like which is used only for triboelectrically charging the toner, have been used. Of these charging members, such a structure that the layer thickness of toner is regulated by the blade for regulating the toner layer in a predetermined thickness and the toner is electrically charged at the same time is most simple and can be reduced in production cost.

Incidentally, as will be understood from the following description, the developing blade used in the developing apparatus according to the present invention embraces not only those which exclusively has a toner layer thickness-regulating function or a triboelectrically charging function but also those having both the toner layer thickness-regulating function and the triboelectrically charging function.

Developing apparatuses provided with conventional developing blades as schematically shown in, e.g., FIGS. 9 to 13.

In a developing apparatus shown in FIG. 9, a blade 113 which has a thickness of 2–4 mm and is formed of a relatively high hardness resin or metal is mounted movably in a blade guide 114 through a coil spring 115. The blade 113 is pressed against a developing roller 112 rotating in a direction of an arrow B under a certain pressure. The developing roller 112 is rotatable in contact with an image bearing member (typically a photosensitive drum) 111 which is disposed opposite to the developing roller 112 and is rotated in a direction of an arrow A.

In a developing apparatus shown in FIG. 10, a plate spring blade 113 formed in an L-shaped character at its one end portion is used. In this apparatus, the other end portion of the blade 113 is fixed in a blade holder 114 formed of a high rigidity material, and the L-shaped character edge (at one end portion) of the blade 113 is pressed against a developing roller 112 by its elastic force at a certain pressure.

In a developing shown in FIG. 11, a blade 113 formed of an elastic material such as a rubber is extended and bonded to one end portion of a blade holder 114 and is pressed against a developing roller 112 at its end portion.

In a developing apparatus shown in FIG. 12, a plate spring blade 113 formed in a U-shaped character at its one end portion is used. In this apparatus, the other end portion of the blade 13 is fixed in a blade holder 114 formed of a high rigidity material and the U-shaped character surface (at one end portion) of the blade 113 is pressed against a developing roller 112 by its elastic force at a certain pressure.

In a developing apparatus shown in FIG. 13, a plate spring blade 113 is fixed in a blade holder 114 at its one end portion and is rounded at the other end portion through round-edge processing (not shown). The round-edged portion of the blade 113 is pressed against a developing roller 112 at a certain pressure.

However, the developing blades used in the developing apparatuses shown in FIGS. 9 to 13 have encountered the following problems to be solved.

For example, the developing blade shown in FIG. 9 involves a problem of occurrences of a stripe due to a strain of the developing roller caused by generated creep and of "fog" caused by unevenness of a toner layer thickness. The developing blade shown in FIG. 10 involves a problems of a deterioration of toner caused by small cracks at the L-shaped character edge. The developing blade shown in FIG. 11 involves a problem of a lowering in triboelectric chargeability caused by generated creep. The developing blade shown in FIG. 12 involves a problem of sticking of toner caused by the limit of flatness. The developing blade shown in FIG. 13 involves a problem of an irregularity in toner layer thickness caused by the limit of flatness and of an occurrence of "fog" caused by the irregularity in toner layer thickness.

The above-described problems are particularly serious in the case where a nonmagnetic monocomponent type developer is used. This is because, in the case of using such a developer, the developing blade is required to permit not only uniform contact thereof with the developing roller under a certain pressure but also uniform charging without causing a deterioration of toner.

Further, a resolution required for the monocomponent type developer is improved year by year in recent digital copying machines and printers. For this reason, demand on a small particle-size toner is increased. Further, toner capable of being fixed at low temperature is desired with energy saving of equipments, so that, combined with color image formation, a thermal characteristic of toner is improved at low temperature.

In these circumstances, when a "toner having a weight-average particle size of not more than 10 μm and an improved thermal characteristic at low temperature (i.e., capable of being fixed at low temperature" is used in the developing apparatuses described above with reference to FIGS. 9–13, by rotating the developing roller for a long period of time while pressing the blade against the developing roller, the toner undergoes a thermal/mechanical stress at the time of passing through the blade. As a result, the toner is stuck to the blade end with continuous printing, so that stable formation of the toner layer on the photosensitive drum is impaired to generate a so-called "white stripe", thus leading to a lowering in image quality.

As another conventional technique, a developing apparatus which is generally effective in solving the above problem has been proposed in Japanese Laid-Open Patent Application No. 2001-147585. In this developing apparatus, a toner layer thickness is regulated by causing a conformed edge of a metallic elastic blade to contact a developing roller. However, in the case of using toner having a small particle size of not more than 10 μm, a charge amount per unit weight of the toner becomes large and a contact surface which regulates the toner is metal, so that the toner is liable to be fixedly deposited on the contact surface by image force. For this reason, with continuous printing, the toner is stuck on the contact surface to result in an occurrence of a white stripe. Accordingly, the above-described problem cannot be solved.

SUMMARY OF THE INVENTION

An object of the present invention is to solve the above described problems in the conventional developing apparatuses.

Another object of the present invention is to provide a developer regulation member and a developing apparatus which are capable of performing either one or both of a layer thickness regulation function and a triboelectric charge function.

Another object of the present invention is to provide a developer regulation member and a developing apparatus which prevent an occurrence of fog image.

Another object of the present invention is to provide a developer regulation member and a developing apparatus which prevent sticking of developer.

Another object of the present invention is to provide a developer regulation member and a developing apparatus which do not cause an occurrence of stripe image even in a deformed state of a developing carrying member.

Another object of the present invention is to provide a developer regulation member and a developing apparatus which can be used in combination with toner having a small particle size and an improved thermal characteristic at low temperature and thus provide a simple apparatus structure, a high image quality, and a high reliability.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
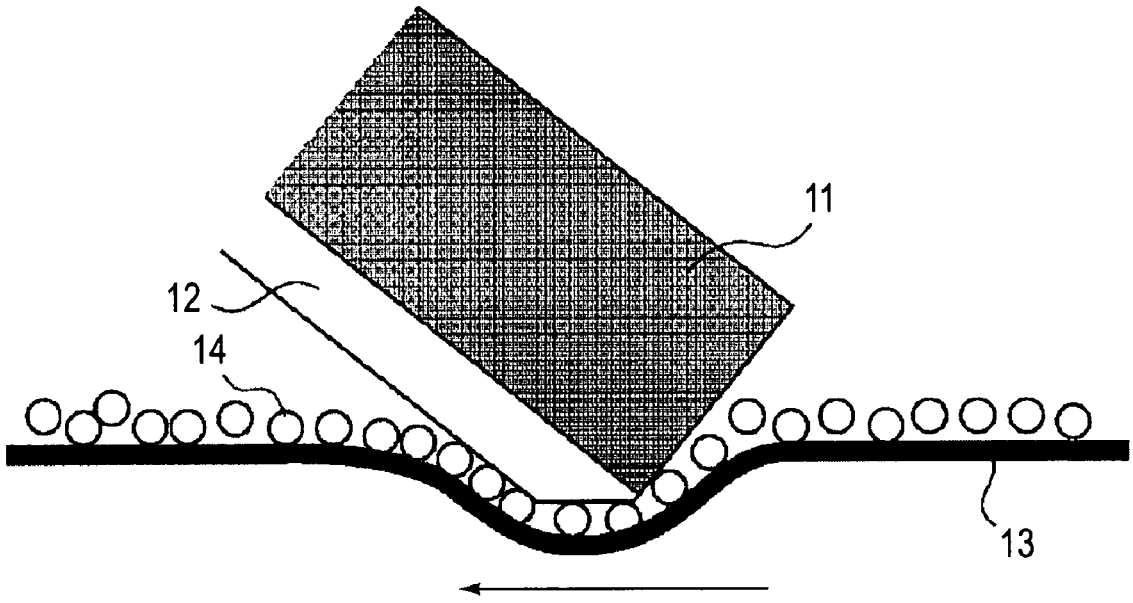
FIG. 1 is a schematic sectional view showing an embodiment of the developer regulation member according to the present invention.

Hereinbelow, embodiments of the present invention will be described more specifically with reference to the drawing. In the following description, dimensions materials, and shapes of structural members (means) used in embodiments of the present invention and their relative arrangement should be appropriately modified depending on a structure of an apparatus to which the present invention is applied and various conditions. Accordingly, it should be understood that the scope of the present invention is not limited to the following embodiments.

Figure 2:
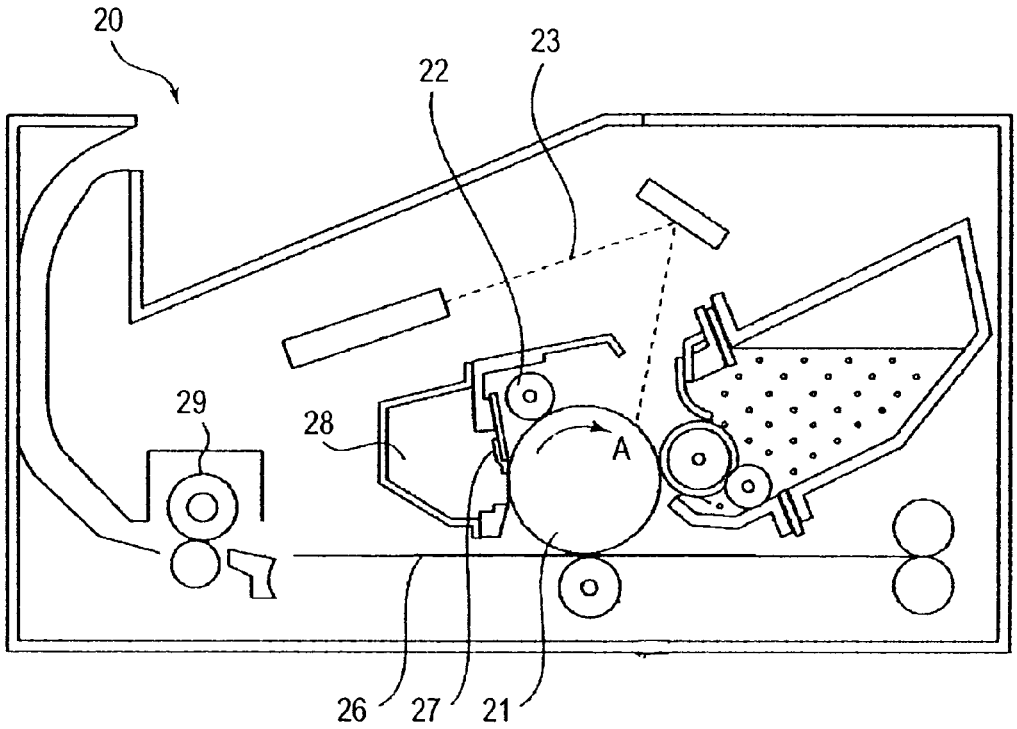
FIG. 2 is a schematic sectional view showing an embodiment of the developing apparatus, according to the present invention, which is mounted in an image forming apparatus.
Figure 3:
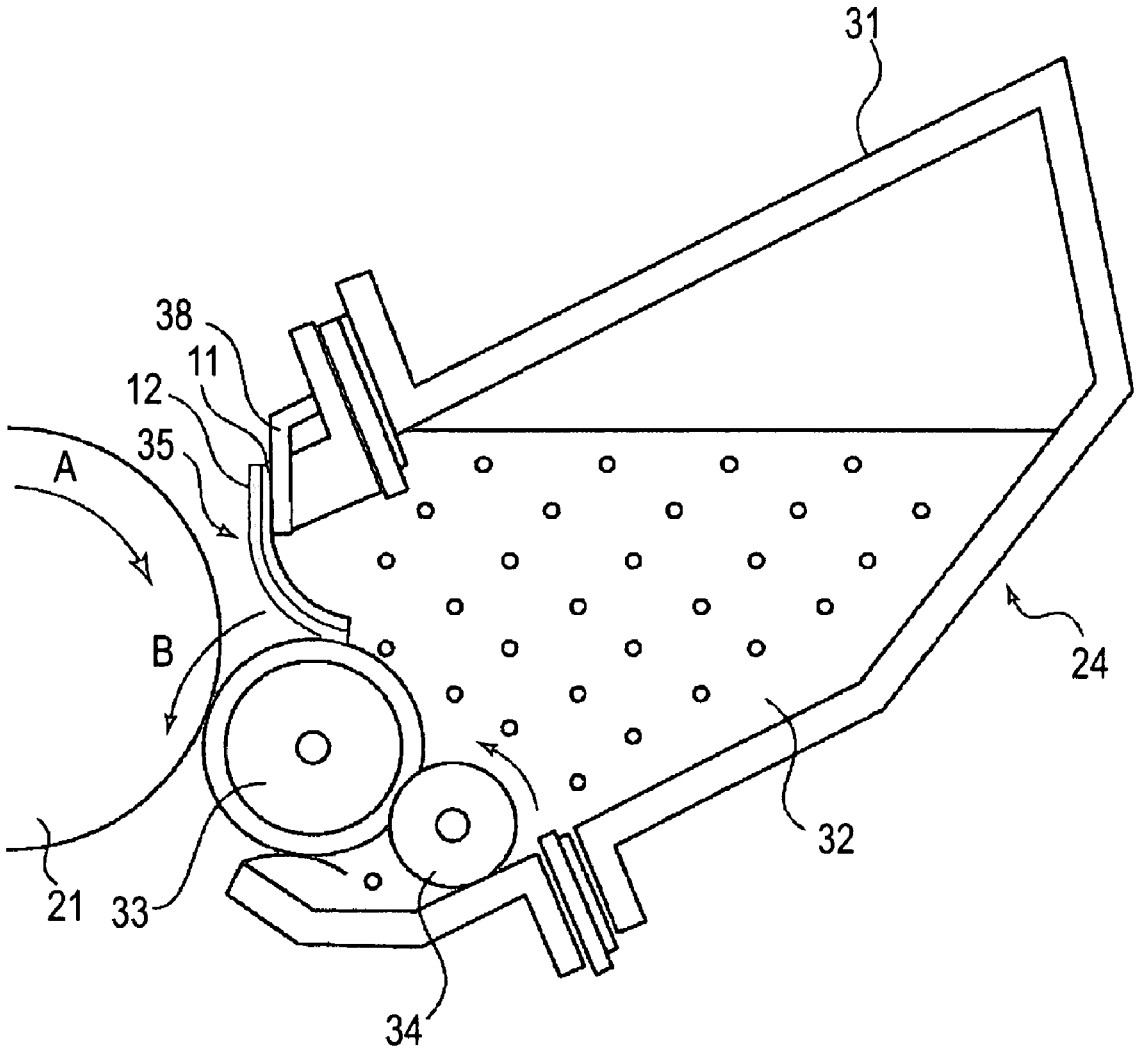
FIG. 3 is a schematic sectional view of the developing apparatus shown in FIG. 2.

FIG. 2 is a schematic sectional view of an image forming apparatus 20 in which the developing apparatus of the present invention is mounted, and FIG. 3 is a schematic sectional view of the developing apparatus of the present invention.

First of all, an image forming operation by an image forming means will be described.

Referring to FIG. 2, a photosensitive drum 21 as an image bearing member is rotated in a direction of an arrow A, and is electrically charged uniformly by a charging apparatus 22. Thereafter, the surface of the photosensitive drum 21 is exposed to laser light 23 emitted from a laser optical apparatus to form an electrostatic latent image thereon.

The electrostatic latent image is developed with toner by a developing apparatus 24 which is pressed in contact with the photosensitive drum 21 in a predetermined entering amount, thus being visualized as a toner image.

The visualized toner image on the photosensitive drum 21 is transferred onto a recording medium 26 as a transfer(-receiving) material. Transfer residual toner remaining on the photosensitive drum 21 without being transferred is scraped with a cleaning blade 27 as a cleaning member and recovered in a waste toner container 28. The cleaned photosensitive drum 21 is repetitively subjected to the above-described image forming process (cycle) to effect image formation.

On the other hand, the recording medium 26 onto which the toner image is transferred is, after being subjected to permanent fixation of toner image by a fixing apparatus 29, discharged out of the image forming apparatus.

The photosensitive drum and the developing apparatus are integrally disposed in a process cartridge detachably mountable to a main assembly of the image forming apparatus.

The developing apparatus 24 is further described based on FIG. 3.

In FIG. 3, a developer container 31 containing, as developer, negatively chargeable nonmagnetic monocomponent toner 32 is disposed. The developing apparatus 24 includes a developing roller 33 which is located at an opening extending in a longitudinal direction of the developer container 31 and is disposed opposite to the photosensitive drum 21. The developing roller 33 develops the electrostatic latent image on the photosensitive drum 21 which the toner to be visualized.

The photosensitive drum 21 is a rigid body which comprises an aluminum cylinder as a support and a photosensitive layer coated in a predetermined thickness around the peripheral surface of the aluminum cylinder. During image formation, the photosensitive drum 21 is uniformly charged to a charge potential (dark part potential) Vd=−500 V by the charging apparatus, and a portion exposed to light by a laser in accordance with an image signal has a (light art) potential Vl=−100 V. At the light part (having the potential Vl), a DC voltage Vdc=−300 V is applied to a core metal of the developing roller 33 as a developing bias voltage, so that reversal development with the negatively chargeable toner is performed.

The developing roller 33 having an elasticity has almost right half thereof located within the developer container 31 and almost left half thereof being exposed from the developer container 31. A part of the exposed surface of the developing roller 33 is disposed in contact with and opposite to the photosensitive drum 21 so as to be pressed against the photosensitive drum 21 in a predetermined entering amount. In this embodiment, the surface of the developing roller 33 contacts and enters the surface of the photosensitive drum 21 in an entering amount of 50 μm. In such a contact developing scheme that the developing roller is caused to contact the photosensitive drum, the developing roller may preferably possess elasticity.

The developing roller 33 is rotated in a direction of an arrow B and the surface of which has an appropriate unevenness so as to improve a friction probability and permit a good conveyance performance of toner 32. The developing roller 33 in this embodiment has a two-layer structure comprising a silicone rubber support layer and a surface coating layer of acrylic-urethane rubber. The surface coating layer has a center-line average roughness Ra of 0.6–1.3 μm, and the developing roller 33 has an ASKER-C hardness of 45–65 degrees, a microrubber hardness of 35–55 degrees as measured by a microrubber hardness meter ("MD-1", mfd. by Kobunshi Keiki K.K.), and an electric resistance of $10^4$–$10^6$ ohm.

The electric resistance is measured in the following manner.

The developing roller 33 is caused to contact an aluminum sleeve having the same diameter as the photosensitive drum 21 at a contact load of 500 gf (4.9 N). The aluminum sleeve is rotated at the same peripheral speed as the photosensitive drum 21. Incidentally, during ordinary image formation, the photosensitive drum 21 has a diameter of 30 mm and is rotated at a peripheral speed of 900 mm/sec, and the developing roller 33 has a diameter of 20 mm and is rotated at a peripheral speed of 120 mm/sec higher than that of the photosensitive drum 21. Then, to the developing roller 33, a DC voltage of −300 V equal to the ordinary developing bias voltage in this embodiment is applied. At that time, a 100,000-ohm resistance is provided on a ground side and a voltage between both ends of the developing roller 33 is measured to determine an electric resistance of the developing roller 33.

Below the developing roller 33, an elastic roller 34 for supplying toner to the developing roller 33 and scraping yet developed toner is caused to contact the developing roller 33 and is rotatably supported. The elastic roller 34 may preferably have a sponge structure or a fur brush structure wherein fibers, such as rayon and nylon, are planted on a core metal, from the viewpoints of toner supply and yet developed toner scraping. In this embodiment, an urethane-based sponge roller is used and rotationally driven in the same direction as the developing roller 33. Further, the core metal as a rotational shaft of the elastic roller 34 has a potential equal to that of the developing roller 33. Accordingly, when the electrostatic latent image on the photosensitive drum 21 is developed, the same voltage as the developing bias voltage is applied to the elastic roller 34.

As the negatively chargeable nonmagnetic toner 32 as the monocomponent developer in this embodiment, substantially spherical toner is used in order to provide a small particle size and improved transfer efficiency thereby to realize high image quality. More specifically, the spherical toner has a shape factor SF-1 of 100–180 and a shape factor SF-2 of 100–140.

These shape factors SF-1 and SF-2 are determined in the following manner.

By using the FE-SEM (field emission-scanning electron microscope) ("S-800", mfd. by Hitachi, Ltd.), 100 parts of toner image are sampled at random and image information thereof is analyzed by an image analyzer ("Lusex 3", mfd. by Nireco Corp.) through an interface. The shape factors SF-1 and SF-2 are defined as values according to the following equations, respectively.

$$SF\text{-}1=\{(MXLNG)^2/\text{AREA}\}\times(\pi/4)\times 100,$$

$$SF\text{-}2=\{(PERI)^2/\text{AREA}\}\times(\pi/4)\times 100,$$

wherein MXLNG represents an absolute maximum length, AREA represents a projection area of toner, and PERI represents a peripheral length.

The shape factor SF-1 represents a sphericity, and as it is larger than 100, toner is gradually changed from spherical shape to indefinite shape. The shape factor SF-2 represents a degree of unevenness, and as it is larger than 100, a surface unevenness of toner becomes conspicuous.

The toner may be produced through any production process so long as the shape factors thereof are in the above-described ranges. For example, a surface of a conventional toner produced through pulverization can be subjected to plastic spherical treatment under thermal/mechanical stress. Further, it is also possible to use a direct toner production process through suspension polymerization or dispersion polymerization using an aqueous organic solvent in which a monomer is soluble but a resultant polymer is insoluble. It is further possible to use an emulsion polymerization, represented by soap-free polymerization, wherein toner is produced through direct polymerization in the presence of an aqueous polar polymerization initiator.

In this embodiment, it is possible to relatively readily control the shape factors so that SF-1 is 100–180 and SF-2 is 100–140. As a result, the resultant toner has a sharp particle distribution and a particle size of 4–8 μm. Specifically, negatively chargeable toner having a weight-average particle size of about 7 μm and containing not more than 25 particle % of toner particles having a weight-average particle size of not more than 4 μm is produced through a suspension polymerization using styrene and n-butyl acrylate as a monomer, salicylic acid metal compound as a charge control agent, saturated polyester as a polar resin, and a colorant.

The toner may preferably have a weight-average particle size of not more than 10 μm, more preferably not more than 7 μm.

Measurement of the weight-average particle size of the toner is performed by a measuring apparatus ("Coulter Counter TA-II" or "Coulter Multisizer", mfd. by Coulter Co.). As an electrolyte, a 1%-NaCl aqueous solution is prepared by using a reagent of first grade sodium chloride. In 100–150 ml of this electrolytic solution, 0.1–5 ml of a surfactant, preferably alkylbenzensulfonic acid, is added as a dispersing agent, and 2–20 mg of a sample toner is further added. The resultant suspension electrolytic liquid is dispersed in an ultrasonic dispersion device for about 1–3 min. A volume and the number of particles of not less than 2 μm of the sample toner is measured by the measuring apparatus with a 100 μm-aperture, whereby a volume distribution and a number distribution are obtained. From the volume distribution, a weight-average particle size D4 is obtained.

Thereafter, 1.5 wt. % of hydrophobic silica is externally added to the negatively chargeable toner. The addition amount of hydrophobic silica may appropriately be changed. By coating the toner surface with the external additive, it is possible to improve not only the negative chargeability but also flowability due to the presence of minute spacing between toner particles.

Above the developing roller 33, a developing blade 35 as the developer regulation member having elasticity is supported by a supporting metal plate 38 and disposed in contact with the outer peripheral surface of the developing roller 33 at its free edge, in order to regulate an amount of developer carried on the developing roller 33. The contact direction of the developing blade 35 is such that the free edge contacting the developing roller 33 is located upstream from a position extended from a supporting portion of the developing blade 35 in the rotation direction of the developing roller 33.

The developing blade 35 may be supported on the supporting metal plate 38 by fastening with a screw, welding, etc. Further, the developing blade 35 and the supporting metal plate 38 have the same potential as the developing roller 33, so that the same voltage as the developing bias voltage is applied thereto when the electrostatic latent image on the photosensitive drum 21 is developed.

The developing blade 35 comprises, as a first regulation portion, a thin metal plate 11 of phosphor bronze and, as a second regulation portion, an elastic layer of polyamide-containing rubber (polyamide elastomer) 12. On the entire surface of the thin metal plate 11 from one end on the side where the developing blade 35 is supported by the supporting metal plate 38 to the other end (free edge) contacting the outer peripheral surface of the developing roller 33, the polyamide elastomer layer 12 is laminated. Accordingly, the thin metal plate 11 as the first regulation portion is disposed upstream of the polyamide elastomer layer 12 as the second regulation portion in the conveyance direction of developer carried on the developing roller 33. In other words, the second regulation portion is disposed at the opposing surface, of the developing blade, where the developing roller and the developing blade are opposed to each other. The developer regulation member comprises the first and second regulation portions which are different in material as described above and regulate the amount of developer carried on the developing roller 33 by pressing it against the developing roller 33.

The developing blade includes a first regulation portion formed of a material having a Shore D hardness of not less than 70 degrees or metal and a free edge of the developing blade disposed in contact with the developing roller, so that it is possible to uniformly regulate the thickness of layer of developer even when the surface of the developing roller is deformed. On the other hand, in the case where the developing blade contacts the developing roller but the free edge of the developing blade is not in contact with the developing roller, an unevenness in layer thickness of developer is caused to occur when the developing roller has been deformed, thus resulting in an irregularity in development. Incidentally, in the above described embodiment, only a free edge of the second regulation portion is disposed in contact with the developing roller but in addition to the second regulation portion, a free edge the thin metal plate as the first regulation portion may also be disposed in contact with the developing roller depending on the angle of the contact of the developing blade with the developer roller.

The thin metal plate 11 may preferably be formed of metal, such as SUS stainless steel or a material having a Shore D hardness of not less than 70 degrees, such as polypropylene, ABS (acrylonitrile butadiene styrene), polycarbonate or polyacetate. The material may be electroconductive or nonelectro-conductive. In addition to the polyamide elastomer, the elastic layer 12 may also be formed of a material having an electric resistance higher than metal, preferably not less than $10^6$ ohm.cm (as measured according to IEC 93 under an environment of 23° C./50% RH), more preferably not less than $10^8$ ohm.cm. The electric layer 12 may have a hardness such that it is softer than metal, and may preferably be those having a Shore D hardness of not more than 70 degrees (e.g., polypropylene, nylon, polyester elastomer, etc.), more preferably be those having a Shore D hardness of not more than 40 degrees (e.g., (TPU thermoplastic polyurethane) etc.).

The polyamide elastomer comprises polyamide and polyester which are linked with an ester linkage or an amide linkage.

The anode component is not particularly limited but may generally be selected from the group consisting of 6-nylon; 6,6-nylon; 6,12-nylon; 11-nylon; 12-nylon; 12,12-nylon; and copolyamides obtained through polycondensation of monomers of these nylons. In a preferred embodiment, an amide component obtained through carboxylation of a terminal amino group of polyamide with dibasic acid etc. Examples of the dibasic acid may include: aliphatic saturated dicarboxylic acids, such as oxalic acid, succinic acid, adipic acid, suberic acid, sebacic acid, and dodecanedioic acid; aliphatic unsaturated dicarboxylic acids such as maleic acid; aromatic dicarboxylic acids, such as phthalic acid, and terephthalic acid; and polydicarboxylic acids comprising the above-described dibasic acids and diols, such as ethylene glycol, butanediol, hexanediol and octanediol. As the polyether component, it is possible to use polyethers, such as polyethylene glycol, polypropylene glycol, and polytetramethylene glycol; and polyether diamine having an aminated terminal group.

The polyamide elastomer used in this embodiment comprises 12-nylon as the polyamide component, dodecanedioic acid as the dibasic acid, and polytetramethylene glycol as the polyether component. These components are reacted and dried for a predetermined number of hours, followed by lamination on the phosphor bronze thin metal plate.

Figure 4:
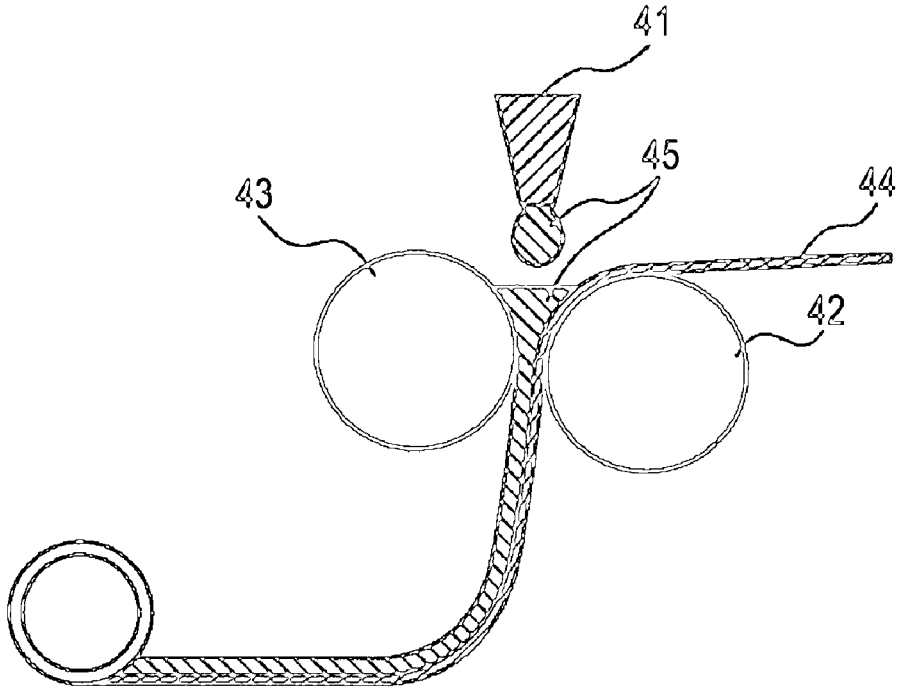
FIG. 4 is a schematic sectional view for explaining a production process of a developing amount regulation blade according to the present invention.

The developing blade may be prepared through, e.g., a roll coating method shown in FIG. 4. First, a surface transfer sheet 44 is mounted on a roller 42, and a starting material 45 for the blade member is fed from a nozzle 41 through a predetermined spacing between the roller 42 and a roller 43 and then is solidified. As a result, a blade member having a charge control surface coated with the surface transfer sheet is obtained.

As the surface transfer sheet, films of polyester resin, polyamide resin, polyolefin resin, a copolymer of these resins, and an alloy of these resins, may be used. Of these films, those of at least one species of the material selected from the group consisting of polyethylene terephthalate, polyethylene-2,6-naphthalate, a copolymer of these, and a composite of these, may preferably be used.

Figure 5:
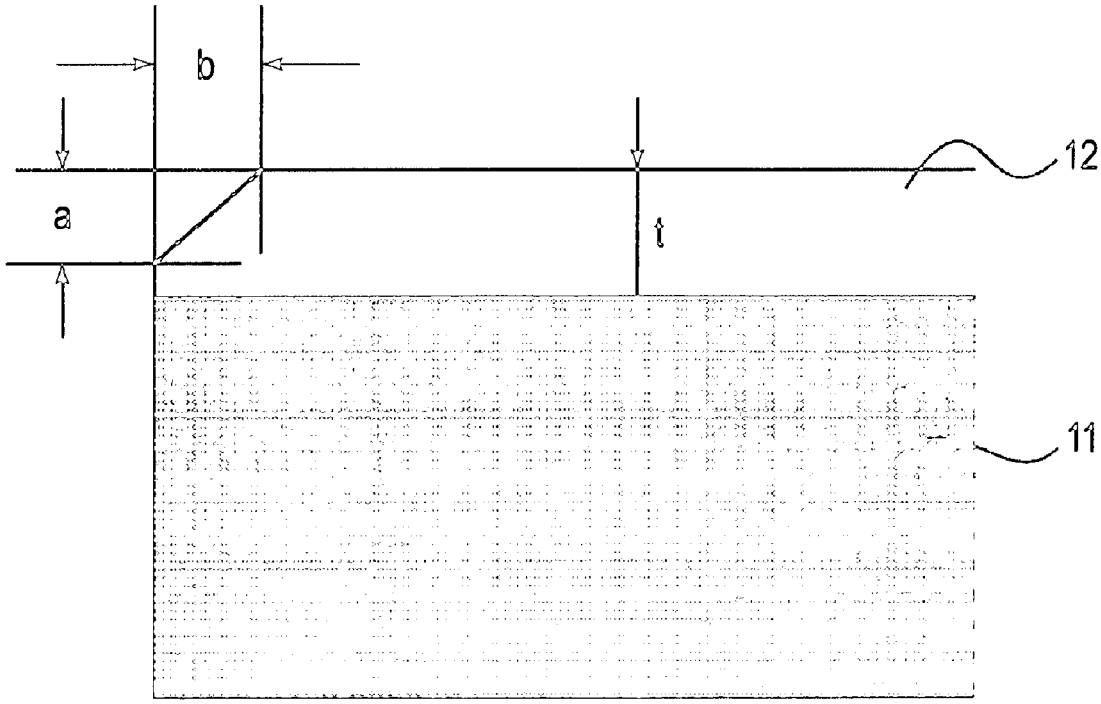
FIG. 5 is a schematic sectional view of the developer regulation member of the present invention.

Then, the above prepared blade member having the charge control surface coated with the surface transfer sheet is cut from the surface transfer sheet side so that its end portion has a predetermined shape (an inclined portion) by using a method, such as punching. The blade member has an edge portion, for regulating developer, which has a shape as shown in FIG. 5. This shape is provided by polishing but may also be provided by another method, such as molding.

The developing blade used in the present invention may preferably be prepared so as to satisfy the following relationship:

$$-20<t-a<25, \text{ and} \quad (1)$$

$$t-b<25, \quad (2)$$

wherein t represents a thickness (μm) of the elastic layer 12 laminated on the thin metal plate 11, a represents a length (μm) of the inclined portion of the blade in the lamination direction, and b represents a length (μm) of the inclined portion of the blade in a direction perpendicular to the lamination direction.

In this embodiment, a=20 μm and b=20 μm are provided.

The developing blade 35 in this embodiment is disposed in contact (abutment) with the developing roller 33 at a contact (abutment) pressure of 20–40 g/cm. A nip (width) between the developing roller 33 and the developing blade 35 (i.e., a distance from the developing blade edge to a portion at which the developing roller 33 and the developing blade 35 are in a noncontact state) is 0.8–1.3 mm. The thin metal plate 11 of phosphor bronze has a thickness of 120 μm, and the elastic layer 12 of polyamide elastomer has a thickness of 30 μm.

A print out test on 1000 sheets was performed by using the above described image forming apparatus 20 and the developing apparatus 24 in environments normal temperature/normal humidity (NT/NH) (25° C./60% RH), low temperature/low humidity (LT/LH) (15° C./10% RH), and high temperature/high humidity (HT/HH) (30° C./80% RH). In all the environments, toner sticking onto the developing blade is not caused to occur, and the developing blade per se has a high triboelectric chargeability, thus effectively imparting triboelectric charge to the toner. Accordingly, it was possible to obtain a high quality image with no fog image and no occurrence of stripe image even in such a circumstance that the developing roller caused creep deformation.

Hereinbelow, the present invention will be described more specifically based on experiments.

[Experiment 1]

When the printout test was performed in the NT/HH (30° C./60% RH) environment, the LT/LH (15° C./10% RH) environment, and the HT/HH (30° C./80% RH) environment by using a conventional developing apparatus using a developing blade formed of a phosphor bronze thin metal plate, a degree of occurrence of stripe image became worse in the order of the LT/LH environment, the NT/NH environment, and the HT/HH environment.

Figure 6:
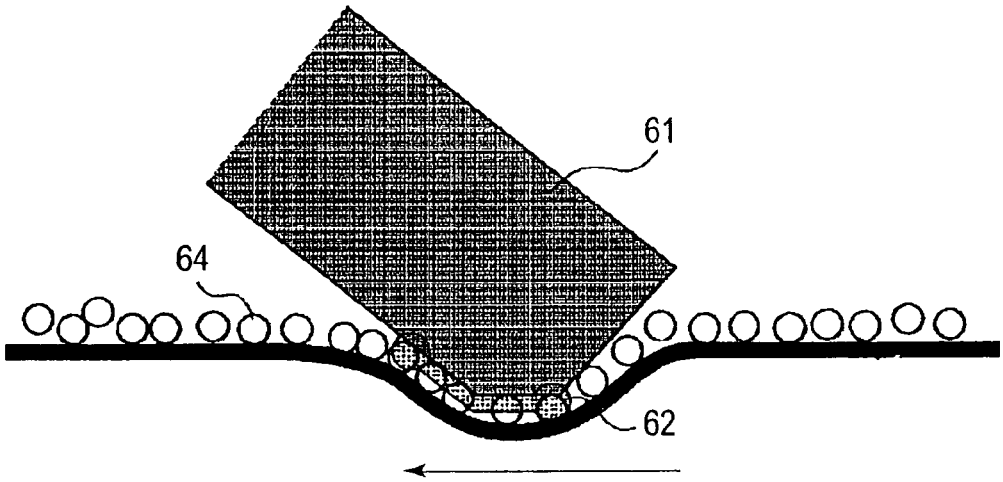
FIG. 6 is a schematic sectional view showing an embodiment of a conventional developer regulation member.

When the developing roller of the conventional developing apparatus was observed, stripe coating failure corresponding to the stripe image were caused to occur, and a sticking matter was deposited on the developing blade in correspondence with the coating failure. As a result, as shown in FIG. 6, it was found that due to the deposition of the sticking matter 62 on the developing blade 61, a toner coating layer 64 was disordered to cause stripe image (image failure).

Further, when a state of occurrence of the sticking was checked, it was found that the sticking matter was generated from the downstream side in the toner conveyance direction at a contact portion between the developing blade and the developing roller and grew toward the upstream side (in the toner conveyance direction).

Accordingly, it was considered that the sticking was attributable to an electric charge of the toner as the developer, and an electrical factor, and that the toner having a large electric charge was liable to be deposited on the metal surface by image force.

Next, the printout (image formation) test on 2000 sheets was performed in the LT/LH (15° C./10%RH) environment by changing an electric resistance of the toner regulation portion, and a degree of occurrence of sticking matter on three developing blades A, B and C described below was observed for evaluation. As the developing apparatus, the conventional developing apparatus was used.

<Developing Blade A>

The conventional elastic blade 61 comprising a 0.12 mm-thick metal plate formed of phosphor bronze shown in FIG. 6 was used.

<Developing Blade B>

A developing blade comprising the conventional developing blade A (0.12 mm-thick phosphor bronze-made thin metal plate) and a 0.5 mm-thick resistance layer which was controlled to have a volume resistivity of $10^3$ ohm.cm by dispersing carbon black particles (as an electroconductive agent) in phenolic resin and was dip-coated on the thin metal plate so as to cover an entire portion from one end of the thin metal plate to the other end (to be in contact with the developing roller) thereof.

<Developing Blade C>

A developing blade comprising the conventional developing blade A (0.12 mm-thick phosphor bronze-made thin metal plate) and a 0.5 mm-thick resistance layer which was controlled to have a volume resistivity of $10^6$ ohm.cm by dispersing carbon black particles (as an electroconductive agent) in phenolic resin and was dip-coated on the thin metal plate so as to cover an entire portion from one end of the thin metal plate to the other end (to be in contact with the developing roller) thereof.

The results are shown in Table 1.

TABLE 1

| Developing blade | Volume resistivity (ohm · cm) | Sticking matter |
|---|---|---|
| A | 0.1 | Occurred |
| B | $10^3$ | Slight occurred |
| C | $10^6$ | Not occurred |

As shown in FIG. 1, sticking of toner was caused to occur in the toner regulation portion of the developing blade at a volume resistivity of not more than $10^3$ ohm.cm.

From the above results, it was found that the occurrence of toner sticking on the developing blade was attributable to the image force acting on the developing blade surface and that the image force was reduced by providing the developing blade surface with a volume resistivity of larger than $10^3$ ohm.cm, whereby the toner sticking onto the developing blade due to an electrostatic force could be prevented.

Accordingly, two developing blades D and E were prepared by using a material which had a high electric resistance and a good triboelectric chargeability with respect to the negatively chargeable toner, an were subjected to a durability test of the developing blades through the printout (image formation) test.

<Developing Blade D>

Figure 7:
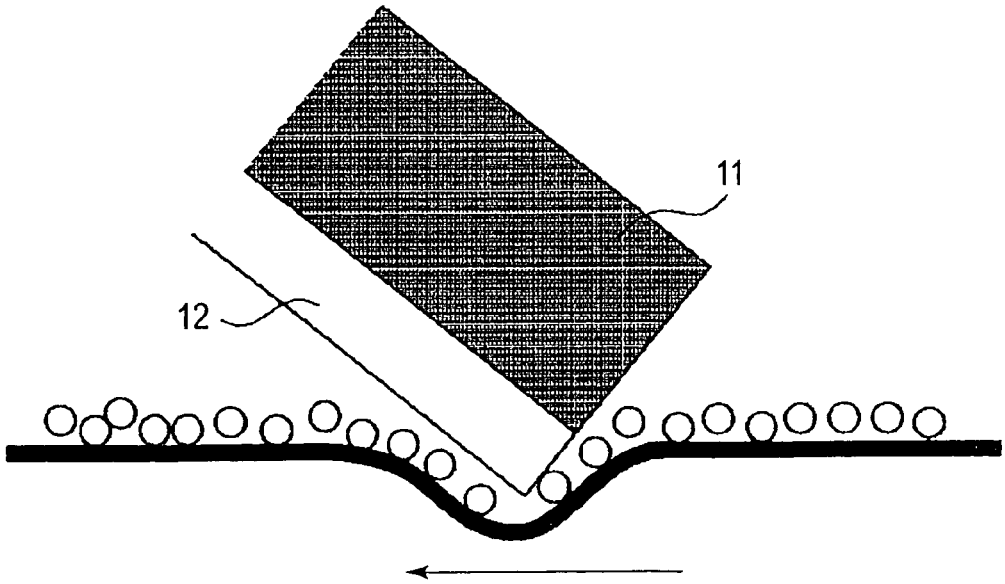
FIGS. 7 and 8 are schematic sectional views showing a developer regulation member used in an experiment in the present invention.

As shown in FIG. 7, an elastic developing blade D having a volume resistivity of $10^8$ ohm.cm was prepared by using a material comprising polyamide elastomer 12 which contained a polyamide component and an elastic polyether component. More specifically, a lamination structure comprising a 0.12 mm-thick phosphor bronze metal plate 11 (first regulation portion) and a 30 μm-thick polyamide elastomer layer 12 (second regulation portion) was prepared by using the roll coating method described in the above described embodiment and then formed through punching.

<Developing Blade E>

Figure 8:
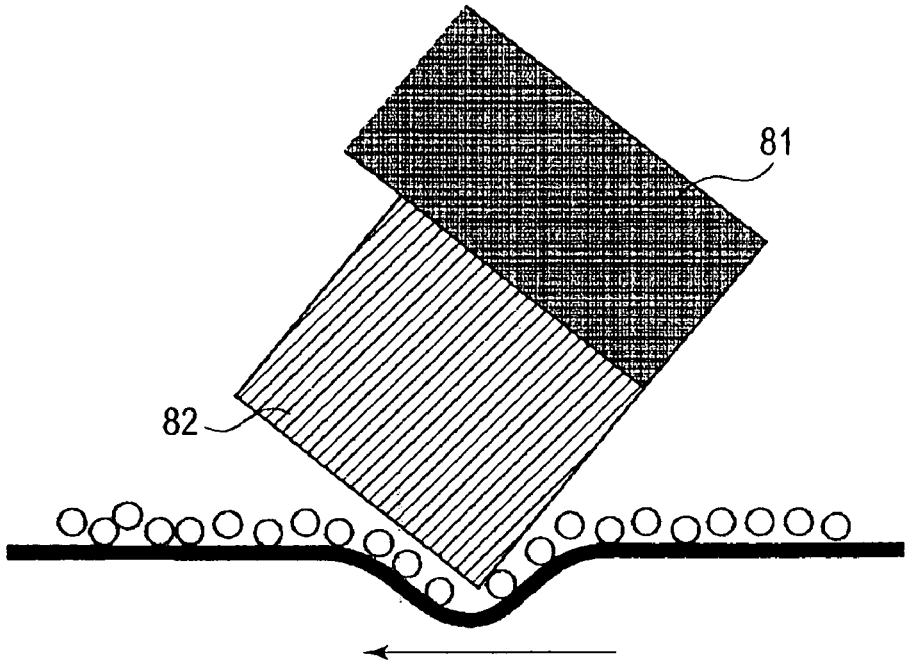
Figure 9:
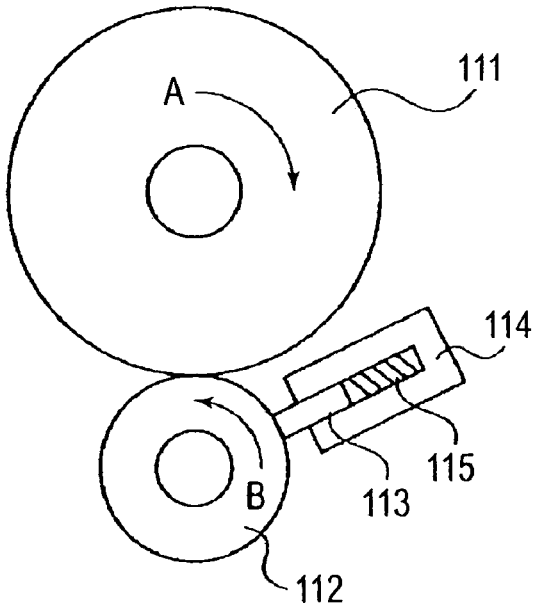
FIG.9 PRIOR ART
FIGS. 9, 10, 11, 12 and 13 are schematic sectional views showing another embodiment of the conventional developer regulation member.
Figure 10:
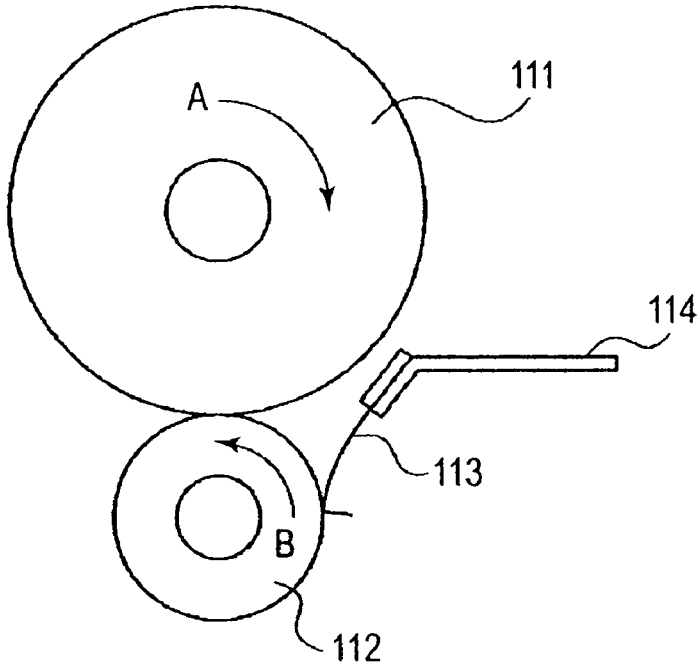
FIG. 10 PRIOR ART
Figure 11:
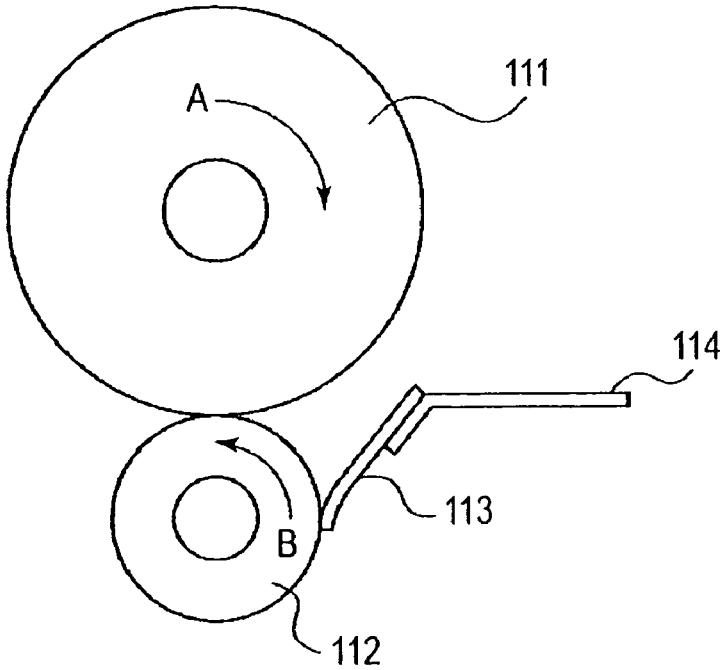
FIG. 11 PRIOR ART
Figure 12:
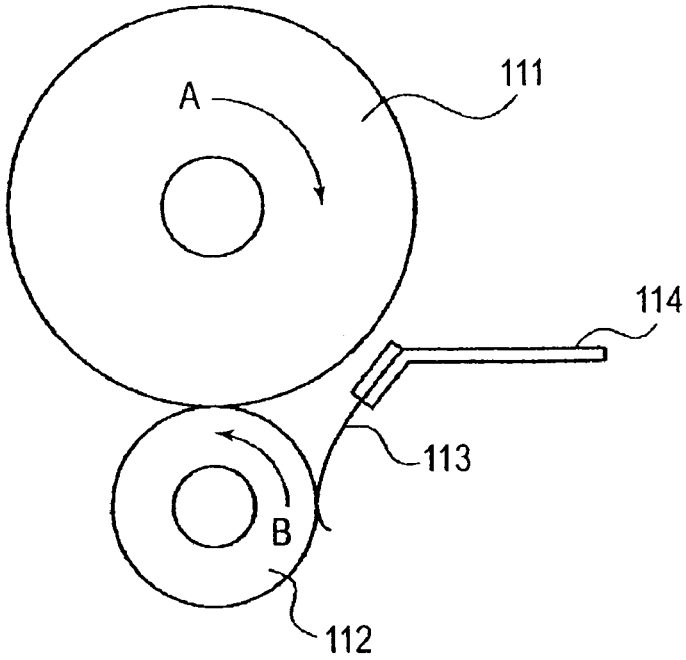
FIG. 12 PRIOR ART
Figure 13:
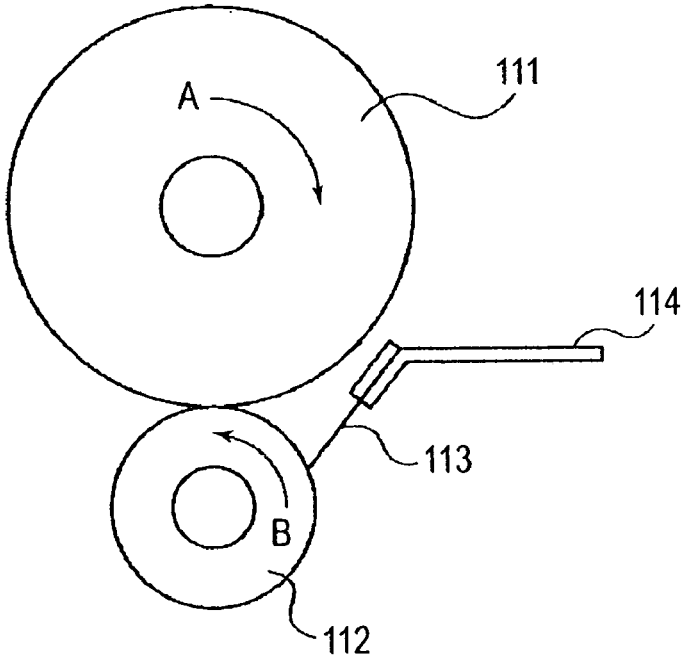
FIG. 13 PRIOR ART

As shown in FIG. 8, an elastic developing blade E having a volume resistivity of $10^9$ ohm.cm was prepared by using a material comprising polypropylene. More specifically, on a 0.12 mm-thick phosphor bronze metal plate 81 having a spring characteristic, a 0.2 mm-thick polypropylene film 82 having a width of 5 mm was fixed with an adhesive. In this embodiment, the developing regulation portion was consisting only of the polypropylene film 82.

By using these developing blades D and E and the conventional developing blade A prepared as above-described, the printout test on 10,000 sheets was performed in the LT/LH environment (15° C./10% RH). As a result, a white stripe was caused to occur from the 2000th sheet with respect to the developing blade A and occur from the 8,000th sheet with respect to the developing blade E. However, no white stripe was caused to occur even on the 10,000th with respect to the developing blade D. The reason why the state of occurrence of the white stripe was different between the developing blade D and E which were prepared by using the similar high resistive material, was that the regulation portions of the developing blade D and E had different hardnesses. The developing blade D had a Shore D hardness of 40 degrees and the developing blade E had a Shore D hardness of 70 degrees, so that the developing blade E imposed a larger stress on the regulation portion of the developing blade E to cause the white stripe. Accordingly, the second regulation portion may preferably have a Shore D hardness of less than 70 degrees.

Further, in order to prevent the toner sticking onto the developing blade due to the electrostatic force by reducing the image force acting on the developing blade surface, the volume resistivity of the second regulation portion located on the downstream side (in the developer conveyance direction) may desirably be larger than that of the first regulation portion, more desirably be not less than $10^6$ ohm.cm.

As described above, by using the developing blade D, the toner sticking onto the developing blade was not caused to occur. Further, the developing blade per se had a high triboelectric chargeability, thus effectively imparting triboelectric charge to the toner. Accordingly, it was possible to obtain a high quality image with no fog image.

[Experiment 2]

However, when the developing apparatus using the developing blade D was left standing for one month in a severe environment of 40° C. and 95% RH, a stripe image was caused to occur at the abutment portion between the developing blade and the developing roller by strain due to creep deformation of the developing roller. When the similar test was performed also with respect to the developing blade E and the developing blade A, the stripe image was improved in the order of the developing blade A, the developing blade E, and the developing blade D. Particularly, the developing blade A did not cause the stripe image. From these results, it was found that a regulation force of toner was increased when the hardness of the toner layer thickness regulation portion as large, thus effectively suppressing the occurrence of the stripe image due to strain caused by creep deformation of the developing roller. Accordingly, it was found that the hardness of the toner layer thickness regulation portion was preferably not less than 70 degrees in terms of Shore D hardness or the toner layer thickness regulation portion was formed of metal. This may be attributable to such a phenomenon that the toner layer thickness regulation portion having a larger hardness is liable to permit the developing blade which can readily follow the deformed portion of the developing roller, thus being capable of providing a uniform layer thickness of developer. Further, as already described above, the abutment (contact) of the free edge of the developing blade against the developing roller was effective in suppressing the occurrence of the stripe image. This also may be attributable to the edge abutment, of the developing blade against the developing roller, permitting the developing blade which is more liable to follow the deformed portion of the developing roller.

In order to suppress the toner sticking onto the developing blade and the stripe image due to the developing roller deformation, the hardness of the firs regulation portion of the developing blade located on the upstream side (where the developing blade does not face the developing roller) in the conveyance direction of developer by the developing roller may desirably be higher than that of the second regulation portion (facing the developing roller).

Based on the above-described findings, the following developing blade (developing blade F) was prepared in order to improve the developing blade D described above.

<Developing Blade F>

As shown in FIG. 1, the polyamide elastomer layer 12 (second regulation portion) of the developing blade D was abraded or beveled to provide the developing blade D with an inclined edge portion in a contact portion of the developing blade D with the developing roller 13. The second regulation portion 12 has an obtuse edge at its end portion.

The beveling of the edge of the developing blade D was performed so as to provide a 20=μm and b=20 μm wherein a represents a length (μm) of the developing blade at the inclined portion thereof in the lamination direction and b represents a length (μm) of the developing blade at its inclined portion in a direction perpendicular to the lamination direction.

By providing the developing blade D with the inclined edge as described above, it was considered that a layer thickness of toner 14 was regulated by the phosphor bronze thin metal plate (first regulation portion) 11 at the contact portion between the developing roller 13 an the developing blade F to prevent the occurrence of the stripe image.

Actually, when the developing apparatus using the developing blade F was left standing for one month in a severe environment of 40° C. and 95% RH and then subjected to the printout test, no stripe image was caused to occur.

Further, in the case of a≦5 μm or b≦5 μm, when the developing apparatus using the developing blade satisfying the relationship was left standing for one month in the severe environment (40° C./95% RH) and then subjected to the printout test, it was found that the toner (layer thickness) regulation effect of the phosphor bronze thin metal plate 11 was not attained to cause the occurrence of stripe image. Further, it was also found that when the printout test was performed in the LT/LH environment (15° C./10% RH) in the case of a≧50 μm, sticking matter of toner onto the phosphor bronze thin metal plate 11 was generated and the white stripe was generated from the 2000th sheet.

Based on the above findings, when the thickness of the elastic layer 12 laminated on the phosphor bronze thin metal plate 11 was t (μm), it was found that the following relationships (1) and (2):

$$-20<t-a<25, \text{ and} \quad (1)$$

$$t-b<25, \quad (2)$$

were satisfied and the edge of the developing blade was processed so as to satisfy the relationships (1) and (2), whereby it was possible to prevent occurrences of the stripe image and the white stripe image.

In this embodiment, the developing blade having the lamination structure of the metal layer and the polyamide elastomer layer is used but the structure of the developing blade may be appropriately modified so long as it can regulate the toner layer in the order of the metal layer and the polyamide elastomer layer from the upstream side in the developer conveyance direction at the toner regulation portion by, e.g., embedding metal in the polyamide elastomer layer.

By using the developing blade F, toner sticking onto the developing blade F is not caused to occur, and the developing blade F per se has a high triboelectric chargeability, thus effectively imparting triboelectric charge to the toner. Accordingly, it was possible to obtain a high quality image with no fog image and no occurrence of stripe image even in such a circumstance that the developing roller caused creep deformation.

In the above-described embodiments, the developer regulation member is constituted by two regulation portions but may be constituted by three or more regulation portions which are laminated together. In such a case of using three or more regulation portions, the inclined portion as described above may preferably be formed in two or more regulation portions other than the most upstream regulation portion in the developer conveyance direction.

By using the developer regulation member according to the present invention, toner sticking onto the developer regulation member is not caused to occur, and the developer regulation member per se has a high triboelectric chargeability, thus effectively imparting triboelectric charge to the toner. Accordingly, it was possible to obtain a high quality image with no fog image and no occurrence of stripe image even in such a circumstance that the developing roller caused creep deformation.

Accordingly, in any environmental conditions, it is possible to form a stable thin developer layer and it becomes possible to provide a developing apparatus capable of providing a high quality image.

This application claims priority from Japanese Patent Application No. 276048/2003 filed Jul. 17, 2003, which is hereby incorporated by reference.

What is claimed is:

1. A developer regulation member, comprising:

developer regulation means for regulating an amount of developer carried on a developer carrying member, said developer regulation means comprising a first regulation portion formed of a first material which has a Shore D hardness of not less than 70 degrees or is metal, and a second regulation portion which is disposed opposite to the developer carrying member and is formed of a material different from the first material from which said first regulation portion is formed, wherein said second regulation portion has an edge which is in contact with the developer carrying member, wherein said second regulation portion has an inclined portion at said edge, and wherein said first and second regulation portions are laminated together and said second regulation portion satisfies the following relationships:

$$-20<t-a<25 \text{ and } t-b<25,$$

where t represents a thickness (μm) in a lamination direction of said second regulation portion, a represents a length (μm) of said inclined portion of said second regulation portion in the lamination direction, and b represents a length (μm) of said inclined portion of said second regulation portion in a direction perpendicular to the lamination direction.

2. A member according to claim 1, wherein said second regulation portion has a hardness lower than said first regulation portion.

3. A member according to claim 1, wherein said second regulation portion has a Shore D hardness of less than 70 degrees.

4. A member according to claim 1, wherein said second regulation portion has a volume resistivity higher than said first regulation portion.

5. A member according to claim 1, wherein said first regulation portion is disposed upstream from said second regulation portion in a conveyance direction of the developer carried on the developer carrying member, and said second regulation portion has a volume resistivity of not less than $10^6$ ohm.cm.

6. A member according to claim 1, wherein said second regulation portion is located downstream from said first regulation member in a conveyance direction of the developer carried on the developer carrying member and has a volume resistivity of not less than $10^6$ ohm.cm.

7. A member according to claim 1, wherein said second regulation portion has an obtuse end portion.

8. A member according to claim 1, wherein the developer has a volume-average particle size of not more than 10 μm.

9. A member according to claim 1, wherein the developer has a volume-average particle size of not more than 7 μm.

10. A member according to claim 1, wherein the developer is a nonmagnetic monocomponent developer.

11. A member according to claim 1, wherein the developer carrying member has an elasticity.

12. A developer regulation member comprising:

developer regulation means for regulating an amount of developer carried on a developer carrying member, said developer regulation means comprising a first regulation portion formed of a first material which has a Shore D hardness of not less than 70 degrees or is metal, and a second regulation portion which is disposed opposite to the developer carrying member and is formed of a material different from the first material from which said first regulation portion is formed, wherein said second regulation portion has an edge which is in contact with the developer carrying member, wherein said developer regulation means further comprises at least one regulation portion, other than said first regulation portion, forming an inclined portion with said second regulation portion, and wherein said first and second regulation portions are laminated together and said at least one regulation portion other than said first regulation portion satisfies the following relationships:

$$-20<t-a<25 \text{ and } t-b<25,$$

where t represents a thickness (μm) in a lamination direction of said second regulation portion and said at least one regulation portion, a represents a length (μm) of said inclined portion in the lamination direction, and b represents a length (μm) of said inclined portion in a direction perpendicular to the lamination direction.

13. A developing apparatus, comprising:

a developer carrying member, having an elasticity, for developing an electrostatic latent image formed on an image bearing member with developer, and a developer regulation member for regulating an amount of developer carried on a developer carrying member, said developer regulation member comprising a first regulation portion formed of a first material which has a Shore D hardness of not less than 70 degrees or is metal, and a second regulation portion which is disposed opposite to the developer carrying member and is formed of a material different from the first material from which said first regulation portion is formed, wherein said second regulation portion has an edge which is in contact with the developer carrying member, and wherein said second regulation portion has an inclined position at the edge, and wherein said first and second regulation portions are laminated together and said second regulation portion satisfies the following relationships:

$$-20<t-a<25 \text{ and } t+b<25,$$

where t represents a thickness (μm) in a lamination direction of said second regulation portion, a represents a length (μm) of said inclined portion of said second regulation portion in the lamination direction, and b represents a length (μm) of said inclined portion of said second regulation portion in a direction perpendicular to the lamination direction.

14. An apparatus according to claim 13, wherein said second regulation portion has a hardness lower than said first regulation portion.

15. An apparatus according to claim 13, wherein said second regulation portion has a Shore D hardness of less than 70 degrees.

16. An apparatus according to claim 13, wherein said second regulation portion has a volume resistivity higher than said first regulation portion.

17. An apparatus according to claim 13, wherein said first regulation portion is disposed upstream from said second regulation portion in a conveyance direction of the developer carried on the developer carrying member, and said second regulation portion has a volume resistivity of not less than $10^6$ ohm.cm.

18. An apparatus according to claim 13, wherein said second regulation portion is located downstream from said first regulation member in a conveyance direction of the developer carried on the developer carrying member and has a volume resistivity of not less than $10^6$ ohm.cm.

19. An apparatus according to claim 13, wherein said second regulation portion has an obtuse end portion.

20. A developing apparatus, comprising:

a developer carrying member, having an elasticity, for developing an electrostatic latent image formed on an image bearing member with developer, and a developer regulation member for regulating an amount of developer carried on a developer carrying member, said developer regulation member comprising a first regulation portion formed of a first material which has a Shore D hardness of not less than 70 degrees or is metal, and a second regulation portion which is disposed opposite to the developer carrying member and is formed of a material different from the first material from which said first regulation portion is formed, wherein said second regulation portion has a volume resistivity higher than said first regulation portion, wherein said second regulation portion has an edge which is in contact with the developer carrying member, wherein said second regulation portion has an inclined position at the edge, and wherein said developer regulation member comprises at least one regulation portion, other than said first regulation portion, forming the inclined portion with said second regulation portion at an end portion of said at least one regulation portion, and wherein said first and second regulation portions are laminated together and said second regulation portion satisfies the following relationships:

$-20<t-a<25$ and $t-b<25$, where t represents a thickness (μm) in a lamination direction of said second regulation portion, a represents a length (μm) of the inclined portion of said second regulation portion in the lamination direction, and b represents a length (μm) of the inclined portion of said second regulation portion in a direction perpendicular to the lamination direction.

21. An apparatus according to claim 13, wherein the developer has a volume-average particle size of not more than 10 μm.

22. An apparatus according to claim 13, wherein the developer has a volume-average particle size of not more than 7 μm.

23. An apparatus according to claim 13, wherein the developer is a nonmagnetic monocomponent developer.

24. An apparatus according to claim 13, wherein said developer carrying member is disposed contactable to the image bearing member.

25. An apparatus according to claim 13, wherein said developing apparatus and the image bearing member are integrally disposed in a process cartridge detatably mounted to a main assembly of an image forming apparatus.

26. A developer regulation member, comprising:

developer regulation means for regulating an amount of developer carried on a developer carrying member, said developer regulation means having a laminated structure comprising a first regulation potion formed of a first material which has a Shore D hardness of not less than 70 degrees or is metal, and a second regulation portion which is disposed at a side near the developer carrying member and which is formed of a material different from the first material from which said first regulation portion is formed, wherein said developer regulation means has an edge which is contactable with the developer carrying member, said edge having an inclined portion and satisfying the following relationships:

$-20<t-a<25$ and $t-b<25$, where t represents a thickness (μm) measured in a lamination direction of said second regulation portion, a represents a length (μm) of the inclined portion of said developer regulation means measured in the lamination direction, and b represents a length (μm) of the inclined portion of said second regulation portion measured in a direction perpendicular to the lamination direction.

27. A member according to claim 26, wherein said second regulation portion has a hardness lower than said first regulation portion.

28. A member according to claim 27, wherein said first regulation portion is disposed upstream from said second regulation portion in a conveyance direction of the developer carried on the developer carrying member, and said second regulation portion has a volume resistivity of not less than $10^6$ ohm.cm.

29. A member according to claim 26, wherein said second regulation portion has a Shore D hardness of less than 70 degrees.

30. A member according to claim 26, wherein said second regulation portion has a volume resistivity higher than said first regulation portion.

31. A member according to claim 26, wherein said developer regulation means has a regulation portion which is located most downstream in a conveyance direction of the developer carried on the developer carrying member and has a volume resistivity of not less than $10^6$ ohm.cm.

32. A member according to claim 26, wherein said second regulation portion has an obtuse end portion.

33. A member according to claim 26, wherein the developer has a volume-average particle size of not more than 7 μm.

34. A member according to claim 26, wherein the developer is a nonmagnetic monocomponent developer.

35. A member according to claim 26, wherein the developer carrying member has an elasticity.

36. A developing apparatus, comprising:

a developer carrying member, having an elasticity, for developing an electrostatic latent image formed on an image bearing member with developer, and developer regulation means for regulating an amount of developer carried on said developer carrying member, said developer regulation means having a laminated structure comprising a first regulation portion formed of a first material which has a Shore D hardness of not less than 70 degrees or is metal, and a second regulation portion which is disposed at a side near the developer carrying member and which is formed of a material different from the first material from which said first regulation portion is formed, wherein said developer regulation means has an edge which is contactable with said developer carrying member, said edge having an inclined portion and satisfying the following relationships:

$-20<t-a<25$ and $t-b<25$, where t represents a thickness (μm) measured in a lamination direction of said second regulation portion, a represents a length (μm) of said inclined portion of said developer regulation means measured in the lamination direction, and b represents a length (μm) of said inclined portion of said second regulation portion measured in a direction perpendicular to the lamination direction.

37. An apparatus according to claim 36, wherein said second regulation portion has a hardness lower than said first regulation portion.

38. An apparatus according to claim 36, wherein said second regulation portion has a Shore D hardness of less than 70 degrees.

39. An apparatus according to claim 36, wherein said second regulation portion has a volume resistivity higher than said first regulation portion.

40. An apparatus according to claim 36, wherein said first regulation portion is disposed upstream from said second regulation portion in a conveyance direction of the developer carried on the developer carrying member, and said second regulation portion has a volume resistivity of not less than $10^6$ ohm.cm.

41. An apparatus according to claim 36, wherein said developer regulation means has a regulation portion which is located most downstream in a conveyance direction of the developer carried on the developer carrying member and has a volume resistivity of not less than $10^6$ ohm.cm.

42. An apparatus according to claim 36, wherein said second regulation portion has an obtuse end portion.

43. An apparatus according to claim 36, wherein the developer has a volume-average particle size of not more than 7 μm.

44. An apparatus according to claim 36, wherein the developer is a nonmagnetic monocomponent developer.

45. An apparatus according to claim 36, wherein said developer carrying member is disposed contactable to the image bearing member.

46. An apparatus according to claim 36, wherein said developing apparatus and the image bearing member are integrally disposed in a process cartridge detatably mounted to a main assembly of an image forming apparatus.

* * * * *

UNITED STATES PATENT AND TRADEMARK OFFICE

CERTIFICATE OF CORRECTION

PATENT NO. : 7,239,832 B2
APPLICATION NO. : 10/890147
DATED : July 3, 2007
INVENTOR(S) : Koichiro Takashima et al.

It is certified that error appears in the above-identified patent and that said Letters Patent is hereby corrected as shown below:

COLUMN 2:
Line 7, "¶In the case where" should read --¶In the case of--;
Line 32, "has a toner" should read --have a toner--;
Line 36, "provided" should read --are provided--; and
Line 56, "developing" should read --developing apparatus--.

COLUMN 3:
Line 14, "a problems" should read --a problem--; and
Line 43, "temperature"" should read --temperature)"--.

COLUMN 4:
Line 63, "dimensions" should read --dimensions,--.

COLUMN 5:
Line 46, "which the toner to be visualized." should read --which causes the toner to be visualized.--;
Line 62, "right half" should read --its entire right half--; and
Line 63, "almost left half" should read --almost its entire left half--.

COLUMN 7:
Line 49, "alkylbenzensulfonic" should read --alkylbenzenesulfonic--.

COLUMN 8:
Line 53, "free edge the" should read --free edge of the--; and
Line 62, "nonelectro-conductive." should read --nonelectroconductive.--.

COLUMN 9:
Line 4, "be those" should read --those--; and
Line 15, "obtained" should read --are obtained--.

COLUMN 10:
Line 18, "environments" should read --environments of--; and
Line 42, "were caused" should read --was caused--.

COLUMN 11:
Line 49, "an were" should read --and were--.

UNITED STATES PATENT AND TRADEMARK OFFICE

CERTIFICATE OF CORRECTION

PATENT NO. : 7,239,832 B2
APPLICATION NO. : 10/890147
DATED : July 3, 2007
INVENTOR(S) : Koichiro Takashima et al.

It is certified that error appears in the above-identified patent and that said Letters Patent is hereby corrected as shown below:

COLUMN 12:

Line 54, “portion as large,” should read --portion was larger,--.

COLUMN 13:

Line 8, “firs regulation” should read --first regulation--;
Line 25, “a 20=μm” should read --a=20 μm--; and
Line 35, “an the developing” should read --and the developing--.

COLUMN 17:

Line 26, “detatably” should read --detachably--; and
Line 32, “portion” should read --portion--.

Signed and Sealed this

First Day of April, 2008

JON W. DUDAS
*Director of the United States Patent and Trademark Office*